US005423264A

United States Patent [19]

Siegler et al.

[11] Patent Number: 5,423,264

[45] Date of Patent: Jun. 13, 1995

[54] FIREWORK BOMB WITH INTEGRAL COMBUSTION

[75] Inventors: Jean P. Siegler, Monteux; Jean-Pierre Chastel, Villes-sur-Auzol, both of France

[73] Assignee: Ruggieri, Neuilly-sur-Seine, France

[21] Appl. No.: 103,634

[22] Filed: Aug. 11, 1993

[51] Int. Cl.[6] ..... F42B 4/26; F42B 13/00

[52] U.S. Cl. ..... 102/342; 102/345; 102/351; 102/357; 102/360; 102/505; 102/489

[58] Field of Search ..... 102/342, 345, 351, 352, 102/357, 360, 505, 489

[56] References Cited

U.S. PATENT DOCUMENTS

| | | | |
|---|---|---|---|
| 1,922,081 | 8/1933 | Driggs, Jr. | 102/21 |
| 2,086,618 | 7/1937 | Hitt | 102/23 |
| 3,349,707 | 10/1967 | Wortley, Jr. | 102/37.6 |
| 3,744,419 | 7/1973 | Hand | 102/37.7 |
| 3,760,729 | 9/1973 | Freeman | 102/32 |
| 3,782,285 | 1/1974 | Froehner | 102/32 |
| 3,863,254 | 1/1975 | Turner | 343/18 B |
| 4,406,227 | 9/1983 | Beeker et al. | 102/505 |
| 4,586,439 | 5/1986 | Wrana | 102/438 |
| 4,860,657 | 8/1989 | Steinicke et al. | 102/334 |
| 4,947,754 | 8/1990 | LaRocca | 102/489 |
| 5,025,729 | 6/1991 | Cameron | 102/336 |

FOREIGN PATENT DOCUMENTS 731856 4/1969 Belgium .

*Primary Examiner*—Peter A. Nelson

*Attorney, Agent, or Firm*—Sughrue, Mion, Zinn, Macpeak & Seas

[57] ABSTRACT

Pyrotechnic bomb comprising a body (1) containing a burst charge (2) and flare charges (6) whose dispersion and ignition are ensured during the burst, characterized in that the said body (1) is made at least partially from a pyrotechnic composition.

11 Claims, 3 Drawing Sheets

FIREWORK BOMB WITH INTEGRAL COMBUSTION

DETAILED DESCRIPTION OF THE INVENTION

The present invention relates to firework bombs.

In the field of firework displays, safety has always posed a major problem to the firework maker who has to reconcile the disadvantages from the fallout on the ground of parts which may or may not be smouldering, with the ever more spectacular effects which he wishes to produce.

One of the main causes of the risks of accidents arises from the fallout of casing or residue debris belonging to slowly combusting materials.

Generally, this fallout on the ground continues to burn and causes fires to start which must be quickly controlled if the surroundings are inflammable.

The invention proposes to reduce the disadvantage of fallout and to allow the production of casings participating directly in controlled pyrotechnic effects.

Its subject is therefore a pyrotechnic bomb comprising a body containing a burst charge and flare charges whose dispersion and ignition are ensured during the burst, characterized in that the said body is made at least partially from a pyrotechnic composition.

Figure 1:
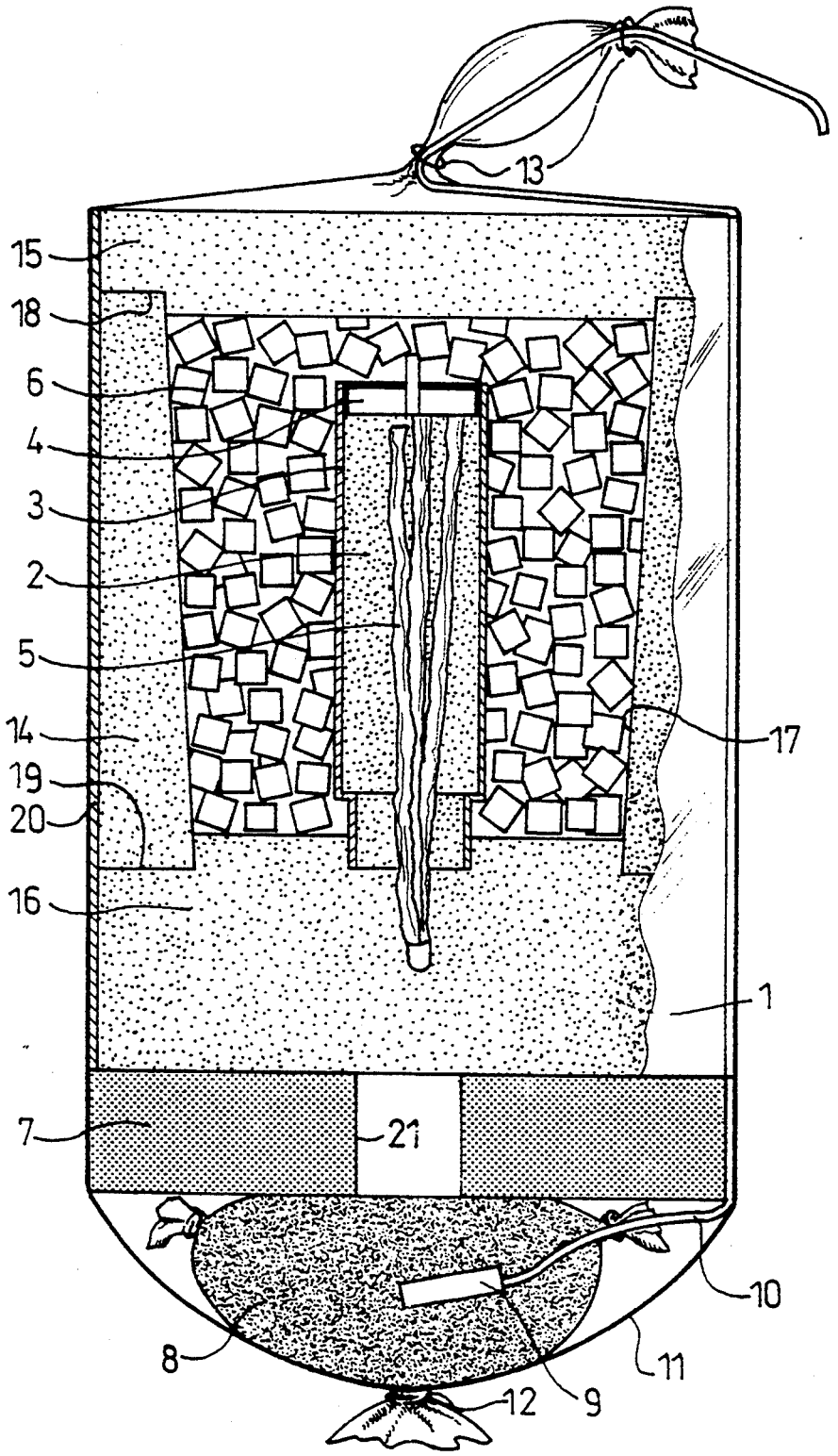
Figure 2:
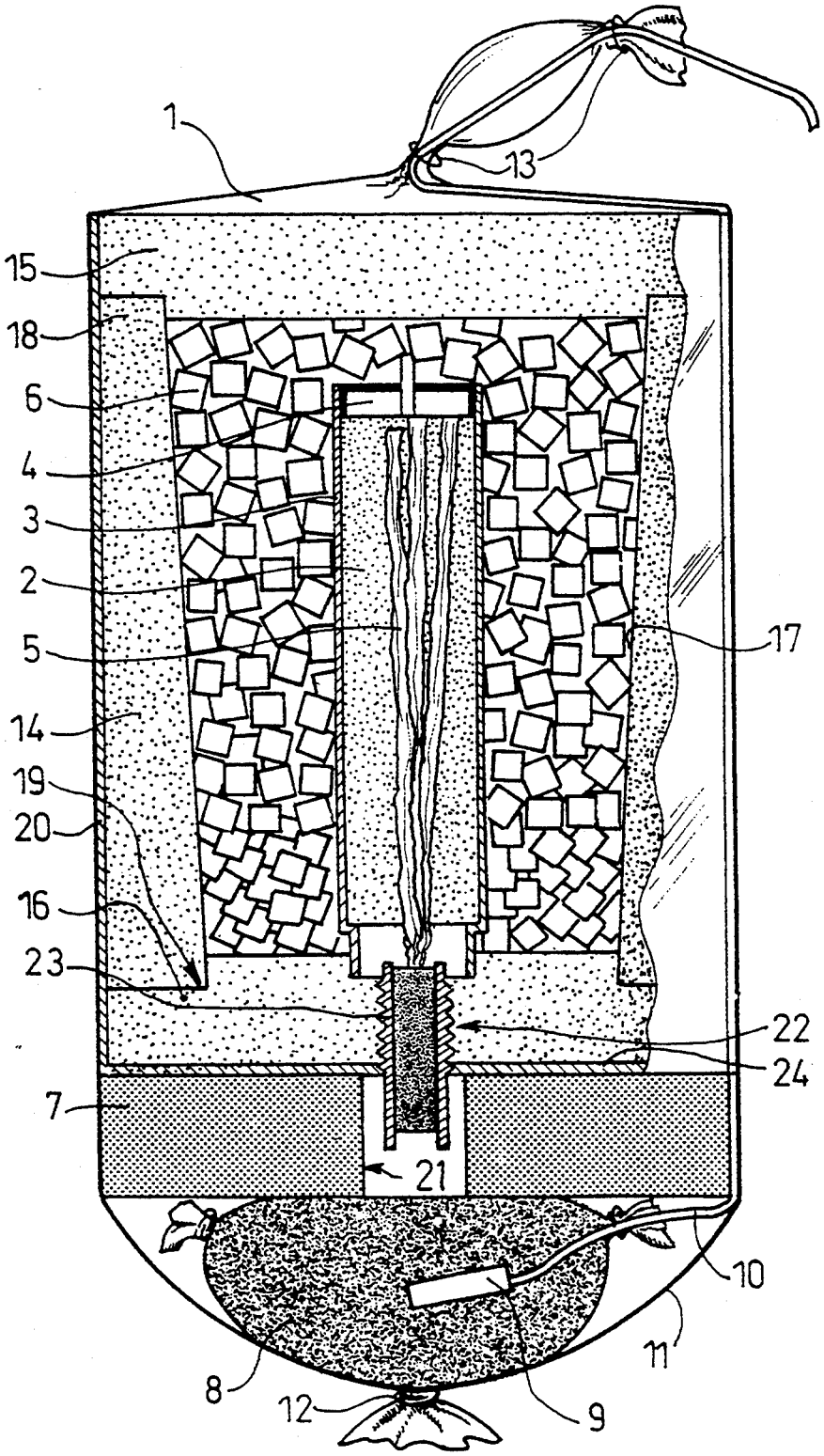

The invention will be better understood with the aid of the description which follows, given merely by way of example and made with reference to the attached drawings, in which:

FIG. 1 is a view in elevation and in section of a firework bomb according to the inventionl FIG. 2 is a view in elevation and in section of a variant of the firework bomb of FIG. 1; and FIGS. 3 to 7 are perspective views of various shapes which may be taken by the body of the firework bomb according to the invention.

Represented in FIG. 1 in section is a firework bomb which includes a hollow body 1 containing a burst charge 2 placed in a polystyrene tube 3 provided with a cover 4. The tube 3 is arranged along the axis of the body 1. Also placed in the tube 3 are ignition booster fuzes 5.

Inside the body and around the burst charge 2 are arranged flare charges or stars 6 of a conventional type.

The bomb moreover includes a wadding disc 7 intended for damping upon departure of the bomb, at the time of its launch.

A black powder shot 8 is arranged beneath the wadding disc 7. It is provided with an ignition device 9 connected to an ignition cord 10 arranged along the body 1.

In the present example, the ignition cord is an electrical conductor.

However, ignition cord is understood to mean any device, irrespective of its nature (electrical, pyrotechnic or other), which is adapted to the mode of use.

The assembly is held by a flexible tubular casing 11, made of kraft paper for example, closed at its two ends by ties 12 and 13, the ignition cord 10 extending from one of the ends of the casings 10 [sic].

The body 1 of the firework bomb according to the invention is made from a pyrotechnic composition. This pyrotechnic composition is for example a mixture of potassium, sulphur and charcoal. The body is formed of three pieces moulded for example by hydraulic press compression, comprising a cylindrical lateral part 14, a cover 15 with the same average thickness as the tubular cylindrical part 14 and a thicker bottom 16 intended to ensure the functions of ascent retardation and ascent effect.

According to a variant, the body 1 may be formed of two pieces.

Advantageously, the cylindrical part 14 which defines, together with the bottom 16 and the cover 15, the inside cavity of the body, has a slightly frustoconical inside wall 17 widening from the bottom 16 towards the cover 15. The ends of the cylindrical part 14 are engaged in shoulders 18, 19 made at the periphery of the cover 15 and of the bottom 16 respectively.

The three elements are glued together.

With the exception of the central part of the bottom 16, the outside of the projectile thus made is inhibited for example by gummed paper 20.

The inhibiting material can also consist of a resin or the like.

The wadding disc 7 includes an axial passage 21 for placing the black powder shot 8 in communication with the bottom 16 of the body 1.

The operation of the firework bomb just described is as follows.

The bomb is placed in a mortar of corresponding calibre, not shown. Ignition is ensured by using the cord 10 to light the black powder shot 8 which propels the projectile by igniting the base of the bottom 16 of the body 1 through the passage 21 in the wadding disc 7.

The bottom 16 burns during the ascent of the projectile thereby making an ascent trail, in the manner of a comet.

The lateral wall of the body 1 being inhibited by the gummed paper 20, the fire does not spread to the remainder of the body.

When the fire reaches the end of the inside cavity of the body 1, it is transmitted to the booster fuzes 5 and to the burst charge 2 which fractures the body 1 while igniting the debris from the cylindrical part 14, from the cover 15 from the unburnt part of the bottom 16 as well as the stars 6 contained in the body.

The fragments of the body 1 while burning form large trails in all directions and the stars 6 light up over a lesser radius. These effects can be boosted by increasing the thicknesses of the cylindrical wall 14 and of the cover 15.

Apart from the wadding disc 7, all the constituents of the firework bomb according to the invention are combustible, so that if the proportions of the constituents are well allotted, almost complete combustion is obtained during fallback of the debris from the body, before the former hits the ground.

For certain applications, it is necessary to avoid the comet effect while the bomb is climbing. The variant of the firework bomb according to the invention represented in FIG. 2 makes it possible to achieve this result. In the bottom 16 of the bomb represented in FIG. 2 an axial retarder body 22 is housed in which an ignition retarding composition 23 is compressed, whilst the lower face of the bottom 16 is inhibited for example by a sheet of gummed paper 24. In this case, the bottom 16 is the same thickness as the cover 15.

For the remainder, the firework bomb represented in FIG. 2 is in all respects similar to that described with reference to FIG. 1.

During the ascent, the retarding composition 23 ignited by the black powder shot 8 burns with no trail effect and, on finishing its combustion, it communicates the fire to the whole bomb which consequently explodes, causing the ignition from inside of the three elements of the body 1 and the illumination of the stars.

The arrangement according to the invention also has the attraction of making it possible to modify the outside and inside geometrical shape of the body of the bomb and thus to obtain the different but perfectly reproducible effects.

Represented in FIGS. 3 to 7 are examples of outside shapes which may be taken by the bodies of the pyrotechnic bombs according to the invention.

As is seen in these figures, the body of the missile still includes a base 30 of cylindrical shape so as to be capable of being fired from a mortar. On the other hand, the head of the body of the bomb can take variable shapes adapted to the effects to be obtained.

Figure 3:
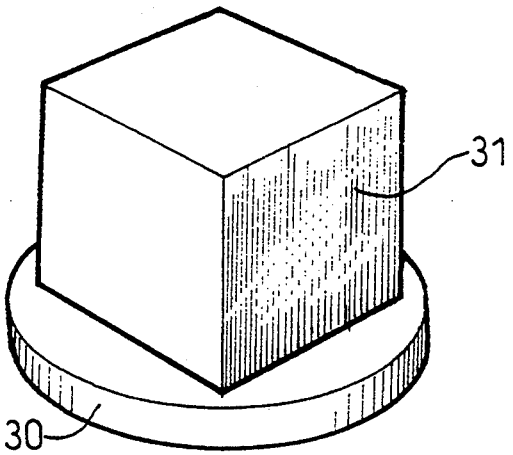
Figure 4:
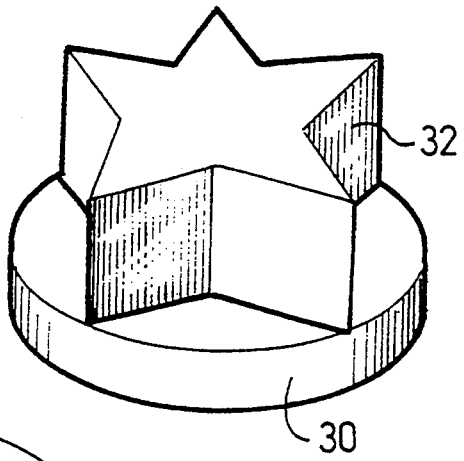
Figure 5:
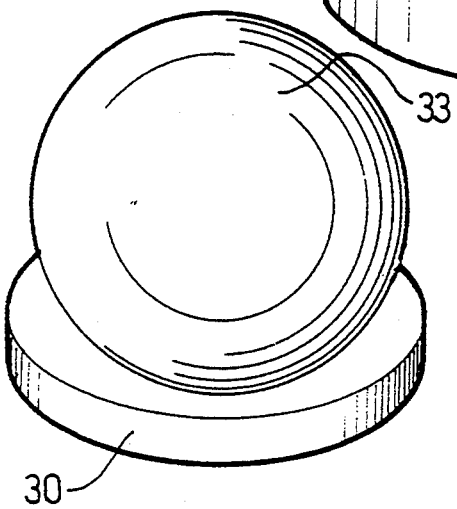
Figure 6:
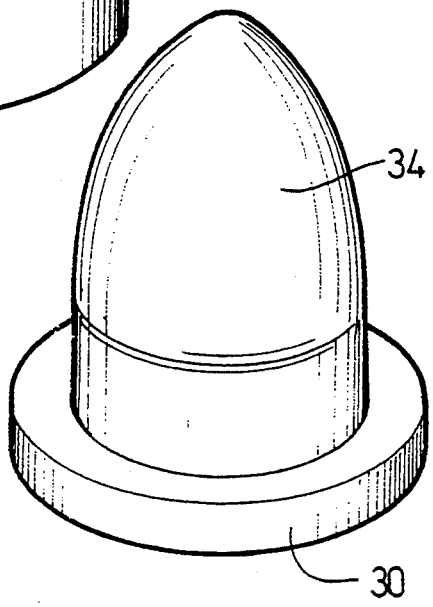

Thus, in FIG. 3 the body includes a head 31 of cubic shape, in FIG. 4 this body has a head 32 of starlike cross-section, in FIG. 5 it has a spherical head 33 and in FIG. 6 the head 34 of the body of the bomb is of ogive shape.

Figure 7:
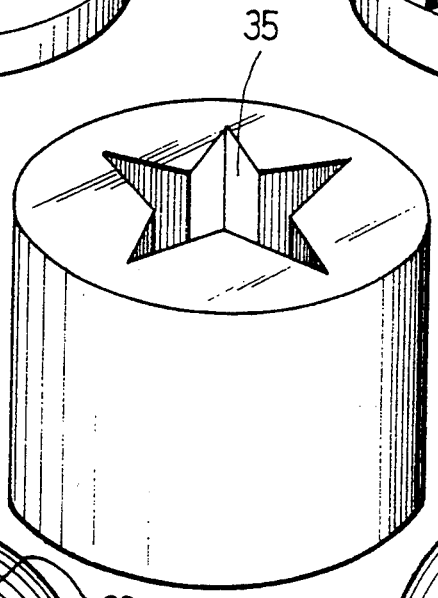

Finally, the body represented in FIG. 7 is of general cylindrical shape and includes an internal cavity 35 of starlike cross-section. The cross-section of the cavity can of course take any other appropriate shapes.

These shapes are not limiting and the manufacturer will advantageously be able to use the technological means appropriate to the art of compositions to obtain shapes leading to the effects sought.

The pyrotechnic bomb just described has, apart from those already indicated, the advantage of increasing the pyrotechnic effectiveness ratio between the pyrotechnic volume and the total volume.

It is therefore possible to obtain effects identical to those obtained with conventional missiles, but using bombs of lesser volume.

We claim:

1. A firework bomb comprising a body (1) containing a burst charge (2) and flare charges (6) whose dispersion and ignition are ensured during the burst, characterized in that the said body (1):

is made at least partially from a pyrotechnic composition; and includes a tubular part (14), a cover (15) and a bottom (16) defining inside the body a cavity which contains the burst charge (2) and the flare charges (6), wherein the outside of the body (1), with the exception of a part at least of the outside surface of the bottom (16) is, clad in an inhibiting material (20).

2. Firework bomb according to claim 1, characterized in that the body of the bomb is at least partially a cylindrical outside shape (30) and includes a head (31) whose outside geometrical shape is ogive.

3. Firework bomb according to claim 1, characterized in that the inhibiting material consists of gummed paper or a resin.

4. Firework bomb according to claim 1, characterized in that a propelling charge (8) provided with an igniter (9,10) is arranged near the outside surface of the bottom (16) of the body (1) with interposition of a disc (7) for damping shocks during launch which is provided with an axial passage (21) for placing the propellant charge (8) in communication with the bottom (16) of the body (1), the assembly being contained in a flexible casing (11).

5. Firework bomb according to claim 4, characterized in that the igniter (9) of the flare charge is provided with a firing cord (10) which stretches along the lateral surface of the body (1) between the said body and the casing (11) and which extends outside the casing.

6. Firework bomb according to claim 1, characterized in that the bottom (16) of the body (1) has a greater thickness than the other walls of the body and thus forms an ignition retarder for the bomb during the latter's ascent.

7. Firework bomb according to claim 6, characterized in that the bottom (16) of the body (1) forms a trail generator on ascent.

8. Firework bomb according to claim 4, characterized in that the bottom (16) of the body (1) includes an axial pyrotechnic retarder (22) in which a retarding composition (23) is compressed which is placed in communication with the propelling charge (8) by way of the axial passage (21) in the damping disc (7), the outside surface of the bottom (16) being inhibited.

9. Firework bomb according to any one of claims 1 and 3 to 8, characterized in that the body of the bomb is at least partially a cylindrical outside shape (30) and includes a head (31) whose outside geometrical shape is cubic.

10. Firework bomb according to claim 1, characterized in that the body of the bomb is at least partially a cylindrical outside shape (30) and includes a head (31) whose outside geometrical shape is of starlike cross-section.

11. Firework bomb according to claim 1, characterized in that the body of the bomb is at least partially a cylindrical outside shape (30) and includes a head (31) whose outside geometrical shape is spherical.

* * * * *